US009453695B2

(12) United States Patent
Luebke

(10) Patent No.: US 9,453,695 B2
(45) Date of Patent: Sep. 27, 2016

(54) AMMUNITION DISPENSING RECEPTACLE

(71) Applicant: Todd Earl Luebke, Maple Grove, MN (US)

(72) Inventor: Todd Earl Luebke, Maple Grove, MN (US)

( * ) Notice: Subject to any disclaimer, the term of this patent is extended or adjusted under 35 U.S.C. 154(b) by 0 days.

(21) Appl. No.: 14/588,575

(22) Filed: Jan. 2, 2015

(65) Prior Publication Data

US 2015/0241151 A1 Aug. 27, 2015

Related U.S. Application Data

(60) Provisional application No. 61/943,100, filed on Feb. 21, 2014.

(51) Int. Cl.

| | |
|---|---|
| ***F41A 9/61*** | (2006.01) |
| ***F41A 9/70*** | (2006.01) |
| ***F42B 39/00*** | (2006.01) |
| *F41A 35/06* | (2006.01) |

(52) U.S. Cl.

CPC ..... *F41A 9/70* (2013.01); *F42B 39/002* (2013.01); *F41A 35/06* (2013.01)

(58) Field of Classification Search

CPC ..... F41A 9/65; F41A 9/66; F41A 9/67; F41A 9/68; F41A 9/69; F41A 9/70; F41A 9/71; F42B 39/002; Y10S 224/931; Y10S 206/817; Y10S 224/918; B65D 83/02; B65D 83/0038; B65D 83/0817; B65D 83/0858

USPC ..... 221/279, 280, 309, 310; 224/196, 239, 224/931

See application file for complete search history.

(56) References Cited

U.S. PATENT DOCUMENTS 885,868 A * 4/1908 Savage ..... F41A 9/95 42/50
2,837,258 A * 6/1958 Williams ..... F42B 39/002 221/279
3,143,819 A * 8/1964 Stevens, Jr. ..... F41A 3/40 42/50
3,219,244 A * 11/1965 Blask ..... F42B 39/002 221/185
3,283,954 A * 11/1966 Spooner ..... F42B 39/002 221/185
3,977,114 A * 8/1976 Poor ..... F41A 9/69 42/50
4,329,802 A * 5/1982 Coonan ..... F41A 9/67 42/50
4,583,659 A * 4/1986 Carter ..... F42B 39/002 221/279
5,056,252 A * 10/1991 Velezis ..... F41A 9/62 42/18
6,817,135 B1 * 11/2004 Jackson ..... F42B 39/002 206/3
7,806,293 B2 10/2010 Altieri et al.
2008/0099503 A1 * 5/2008 Altieri ..... F42B 39/002 221/156
2009/0261119 A1 * 10/2009 Altieri ..... F42B 39/002 221/185
2010/0187271 A1 * 7/2010 Selvetti ..... F41A 9/61 224/196
2010/0281737 A1 * 11/2010 Cahill ..... F41A 9/65 42/50

FOREIGN PATENT DOCUMENTS

FI CH 232921 A * 6/1944 ..... F41A 9/70

* cited by examiner

*Primary Examiner* — Gabriel Klein

(74) *Attorney, Agent, or Firm* — Bennet K. Langlotz; Langlotz Patent & Trademark Works, Inc.

(57) ABSTRACT

Ammunition dispensing receptacles have an elongated tubular body having opposed first and second ends, the body defining a storage chamber, the body having an opening at the first end operable to receive and dispense ammunition, a follower received in the chamber and operable to reciprocate between the first end and the second end, the follower being spring biased toward the first end, and the follower being operable to pivot with respect to the body, such that a varying number of tapered ammunition elements may be supported by the follower. The body may define an elongated channel, and the follower may include a protruding pivot element received within the channel. The channel may have an end portion adjacent to the first end, such that the motion of the follower toward the first end is limited by the end portion of the channel.

14 Claims, 9 Drawing Sheets

AMMUNITION DISPENSING RECEPTACLE

CROSS-REFERENCE TO RELATED APPLICATION

This application claims the benefit of U.S. Provisional Patent Application No. 61/943,100 filed on Feb. 21, 2014, entitled "PORTABLE AMMUNITION DISPENSER," which is hereby incorporated by reference in its entirety for all that is taught and disclosed therein.

FIELD OF THE INVENTION

The present invention relates to firearms, and more particularly to an ammunition dispensing receptacle for tapered cartridges.

BACKGROUND OF THE INVENTION

Users of firearms having magazines with minimal capacities or no magazine, such as shotguns, require the user to carry additional rounds of ammunition while he or she is in the field or out on a shooting range. Numerous types of ammunition pouches and dispensers designed to carry small quantities of individual rounds of ammunition exist, including pouches and bandoliers. Other varieties of ammunition carriers mimic the appearance of box magazines, but operate by gravity instead of having the ammunition fed by a follower and spring. In order to accommodate tapered cartridges, some other types of ammunition carriers utilize a curved banana shape, or require the ammunition cartridges to be in alternating orientations, which requires the user to flip every other one both as the ammunition carrier is loaded and as the ammunition cartridges are withdrawn. Furthermore, some versions are only suitable for use by users who are either right-handed or left-handed, and cannot be easily converted so as to be ambidextrous.

Therefore, a need exists for a new and improved ammunition dispensing receptacle that provides ambidextrous operation by enabling tapered cartridges to be oriented in a user-desired direction when dispensed regardless of whether the user is right-handed or left-handed. In this regard, the various embodiments of the present invention substantially fulfill at least some of these needs. In this respect, the ammunition dispensing receptacle according to the present invention substantially departs from the conventional concepts and designs of the prior art, and in doing so provides an apparatus primarily developed for the purpose of providing ambidextrous operation with all of the cartridges being dispensed in a uniform orientation.

SUMMARY OF THE INVENTION

The present invention provides an improved ammunition dispensing receptacle, and overcomes the above-mentioned disadvantages and drawbacks of the prior art. As such, the general purpose of the present invention, which will be described subsequently in greater detail, is to provide an improved ammunition dispensing receptacle that has all the advantages of the prior art mentioned above.

To attain this, the preferred embodiment of the present invention essentially comprises an elongated tubular body having opposed first and second ends, the body defining a storage chamber, the body having an opening at the first end operable to receive and dispense ammunition, a follower received in the chamber and operable to reciprocate between the first end and the second end, the follower being spring biased toward the first end, and the follower being operable to pivot with respect to the body, such that a varying number of tapered ammunition elements may be supported by the follower. The body may define an elongated channel, and the follower may include a protruding pivot element received within the channel. The channel may have an end portion adjacent to the first end, such that the motion of the follower toward the first end is limited by the end portion of the channel. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
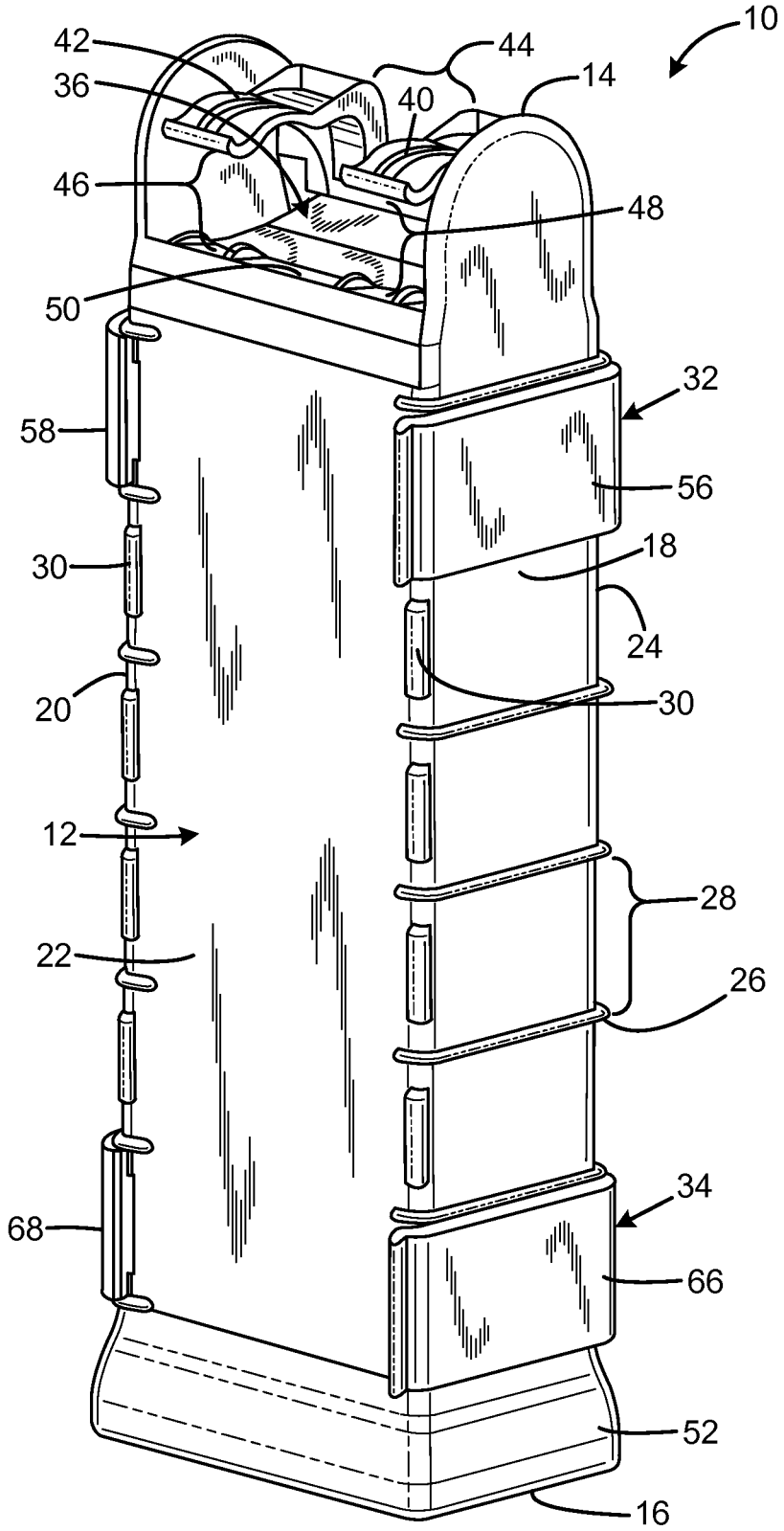
FIG. 1 is a front isometric view of the current embodiment of the ammunition dispensing receptacle constructed in accordance with the principles of the present invention.

An embodiment of the ammunition dispensing receptacle of the present invention is shown and generally designated by the reference numeral 10.

Figure 2:
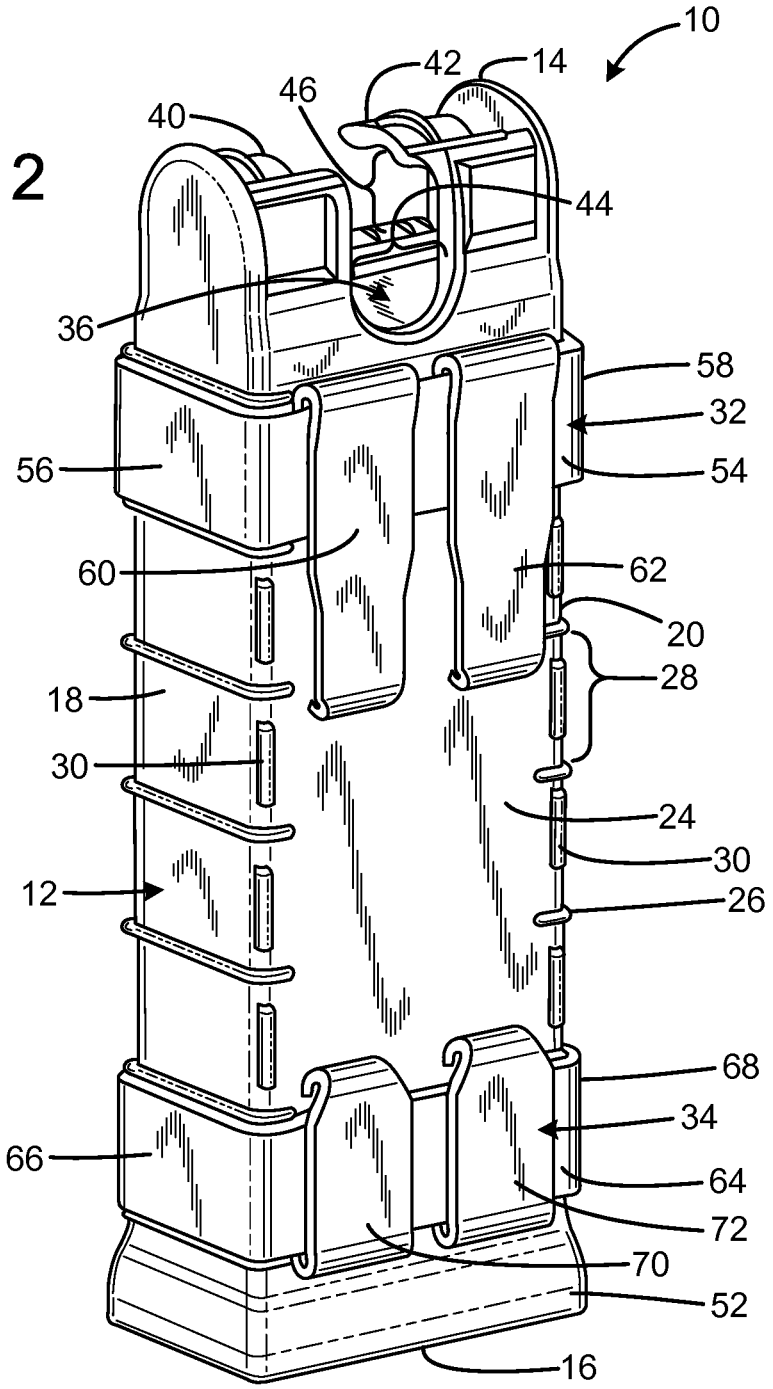
FIG. 2 is a rear isometric view of the ammunition dispensing receptacle of FIG. 1.

FIGS. 1 and 2 illustrate the improved ammunition dispensing receptacle 10 of the present invention. More particularly, the ammunition dispensing receptacle 10 has an elongated tubular body 12 having a top 14, a bottom 16, a left side 18, a right side 20, a front 22, and a rear 24. A plurality of horizontal ridges 26 separated by gaps 28 and retention bumps 30 within the gaps are distributed about the body. The horizontal ridges and retention bumps facilitate handling of the ammunition dispensing receptacle and serve as retention features that enable an upper clip 32 and a lower clip 34 to be securely, but removably connected to the body. The bottom of the body terminates in a flared portion 52.

Figure 4:
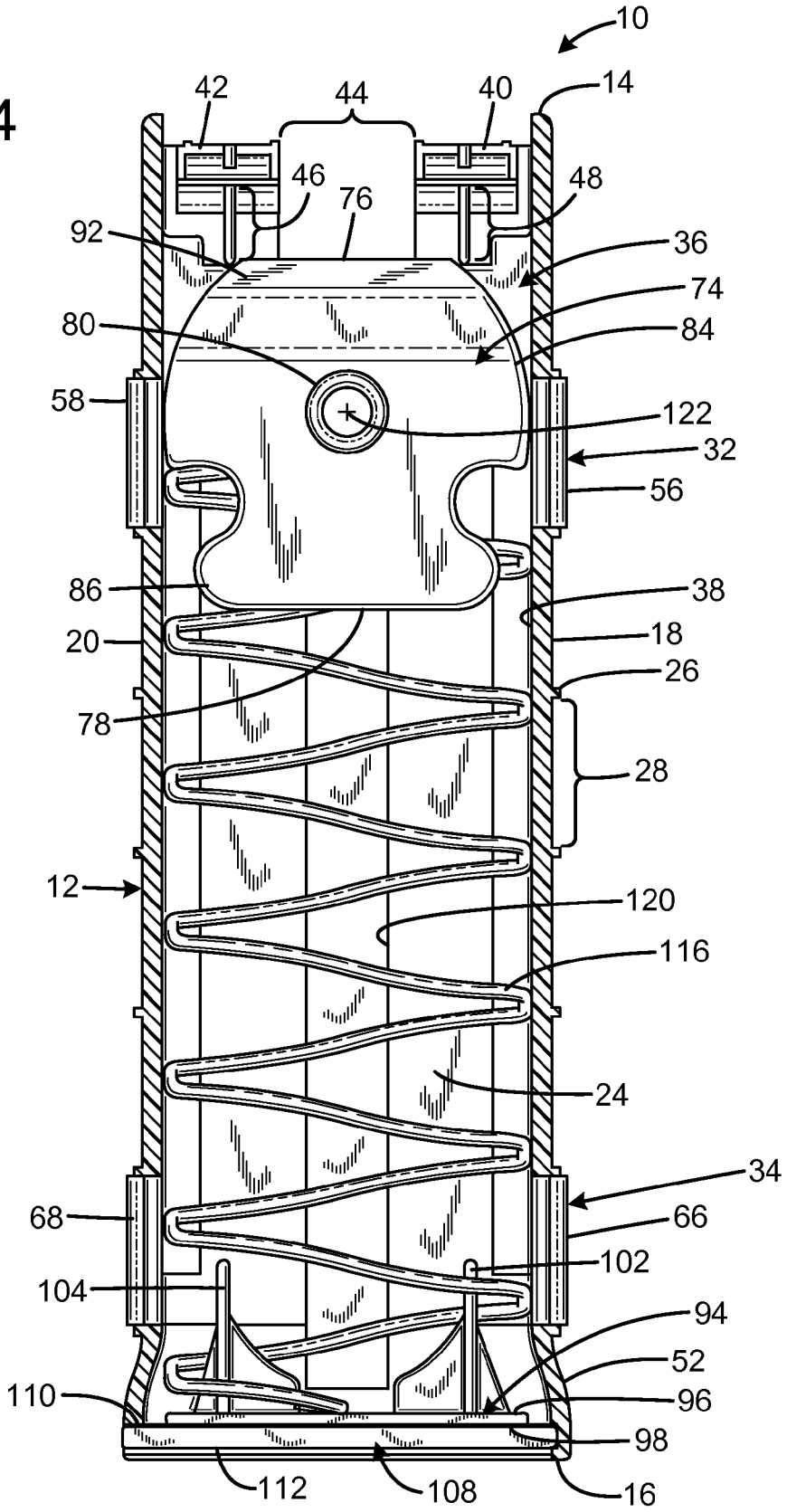
FIG. 4 is a front sectional view of the ammunition dispensing receptacle of FIG. 1 in an unloaded condition.
Figure 5:
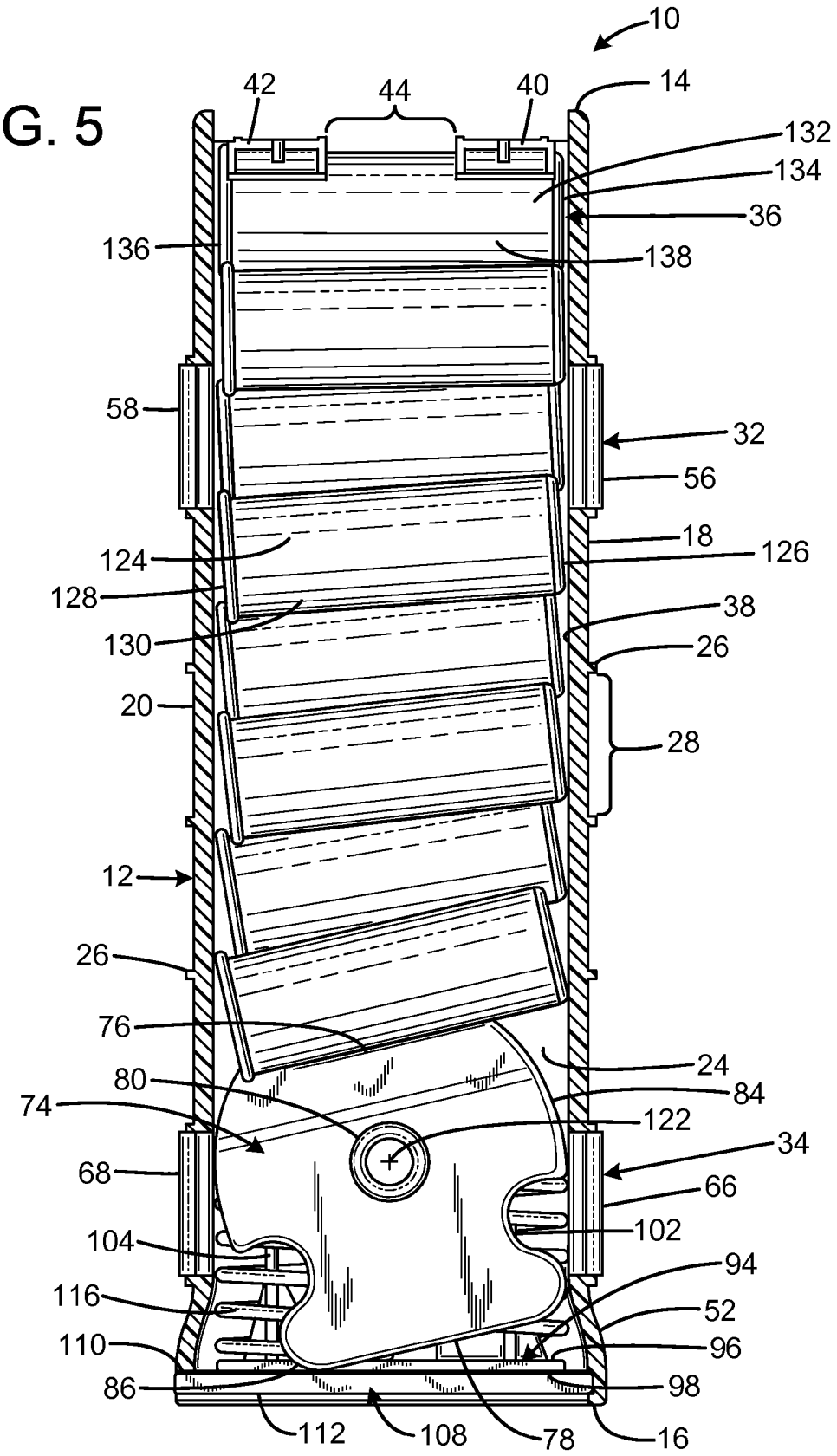
FIG. 5 is a front sectional view of the ammunition dispensing receptacle of FIG. 1 in a fully loaded condition.

The top 14 of the body defines an opening 36 that communicates with an interior storage chamber 38 (shown in FIG. 4) defined by the left side 18, right side 20, front 22, and rear 24. Two flexible semi cylindrical fingers 40, 42 separated by a rear gap 44 define gaps 46, 48 with respect to an upper lip 50. The rear gap 44 has a width of 1 inch, which enables an adult finger to pass between the flexible fingers. The gaps 46, 48 have a width of ¾ inch in the unflexed condition.

The upper and lower clips 32, 34 enable attachment of the ammunition dispensing receptacle 10 to a user's belt or a MOLLE/Pals attachment system. The upper clip has a rear portion 54 with opposed ends connected to a left clamp arm 56 and a right clamp arm 58, respectively. Two downwardly extending belt clips 60, 62 are attached to the rear portion. The rear portion, left clamp arm, and right clamp arm are sized to be closely received within a selected gap 28 between a selected pair of horizontal ridges 26. The left clamp arm and right clamp arm are sized to snap over the associated retention bumps 30 to releasably secure the upper clip to the front 22 or rear 24 of the body 12. The upper clip is suitable for use with a user's belt or a MOLLE/Pals attachment system.

The lower clip 34 is used with a MOLLE/Pals attachment system, and is therefore optional when the ammunition dispensing receptacle 10 is worn attached to the user's belt. The lower clip has a rear portion 64 with opposed ends connected to a left clamp arm 66 and a right clamp arm 68, respectively. Two upwardly extending strap clips 70, 72 are attached to the rear portion. The rear portion, left clamp arm, and right clamp arm are sized to be closely received within a selected gap 28 between a selected pair of horizontal ridges 26. The left clamp arm and right clamp arm are sized to snap over the associated retention bumps 30 to releasably secure the upper clip to the front 22 or rear 24 of the body 12.

Figure 3:
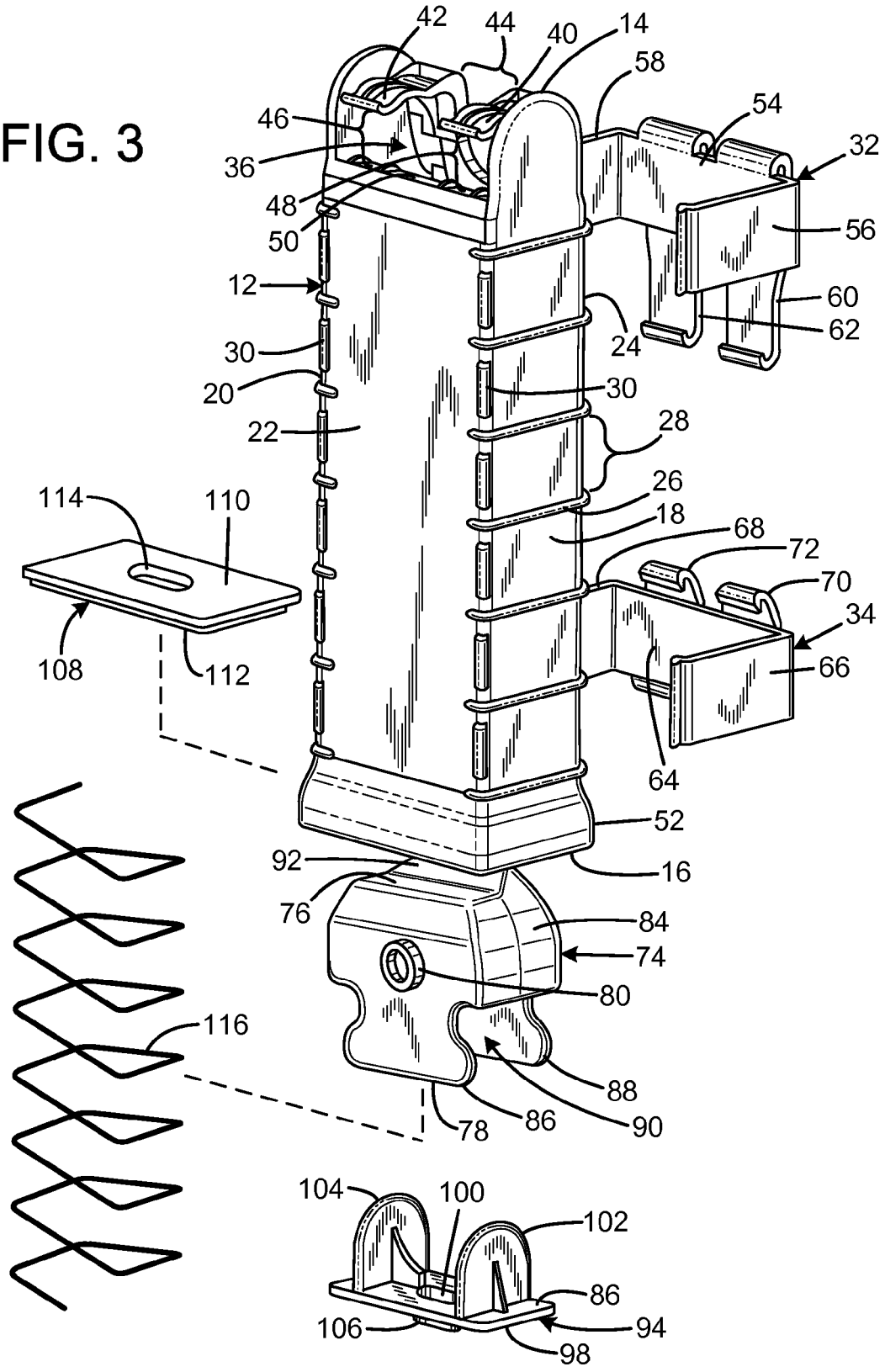
FIG. 3 is an exploded view of the ammunition dispensing receptacle of FIG. 1.

FIG. 3 illustrates the improved ammunition dispensing receptacle 10 of the present invention. More particularly, the bottom 16 of the body 12 is open to receive a follower 74, a rectangular coil spring 116, and a spring plate 94. A floor plate 108 closes the bottom end of the body and secures the follower, spring, and spring plate within the body. The follower 74 has a top 76 with a sloping ramp 92, a bottom 78, protruding front and rear pivot elements 80, 82, and downwardly extending protrusions 86, 88. A channel 90 is defined between the protrusions, and the bottom of the protrusions form rounded lobes. The follower includes rounded profile surface portions 84 extending downward from either side of the top. The spring plate 94 has a top 96, a bottom 98, and defines a central aperture 100. A tubular downward protrusion 106 extends below the bottom of the spring plate and communicates with the central aperture. Upper protrusions 102, 104 extend upwardly from the top of the spring plate and support the coil spring when the coil spring is compressed. The floor plate 108 has a top 110, a bottom 112, and defines a central drain hole 114.

FIGS. 4-6C illustrate the improved ammunition dispensing receptacle 10 of the present invention. More particularly, the ammunition dispensing receptacle 10 is shown in an unloaded state in FIGS. 4 and 6, a fully loaded state in FIG. 5, and loaded with a single round in FIG. 6A. The rectangular coil spring 116 is compressed between the top 96 of the spring plate 94 and the spring groove 140 defined at the top of the channel 90 of the follower 74. As a result, the rectangular coil spring urges the follower upwards towards the top 14 of the body 12. The front pivot element 80 and rear pivot element 82 of the follower are received within front and rear channels 118, 120 defined in the front 22 and rear 24 of the body. The channels have a selected height that limits upward movement of the follower towards the top of the body. In the current embodiment, the height of the channels is selected such that the top front of the follower is level with the upper lip 50 when the ammunition dispensing receptacle is either unloaded or contains a single ammunition cartridge. The channels are sufficiently wide such that the follower can pivot about a pivot axis 122 and move up and down within the channels, but lateral movement of the follower is limited.

The left 18 and right 20 side walls that define the storage chamber 38 are spaced apart by a selected width. The profile surface portions 84 of the follower 74 have a radius of slightly less than half the selected width, such that the follower is closely received in the storage chamber, and motion of the follower toward and away from the left and right side walls is limited, while pivoting of the follower and reciprocating of the follower along the length of the storage chamber are enabled. The protrusions 86, 88 extend below the follower to a radius greater than the radius of the profile surface portions, such that pivoting of the follower is limited by the protrusions. In the current embodiment, the left and right side walls are spaced apart by 2¾ inch, the radius of the profile surface portions of the follower is 1¼ inch, and the radius that the protrusions extend below the follower is 1⅜ inch.

When the ammunition dispensing receptacle 10 is in the fully loaded condition, the flared portion 52 provides room for the coil spring 116 to compress, and the upper protrusions 102, 104 on the top 96 of the spring plate 94 prevent the compressed coil spring from collapsing. The ammunition elements 124 each have a front 126, a rear 128, and an exterior 130. The uppermost ammunition element 132 also has a front 134, a rear 136, and an exterior 138. Because the ammunition elements taper from the rear to the front, the follower 74 must be able to pivot about the pivot axis 122 in order to accommodate their taper. Because the follower can pivot both clockwise and counterclockwise about the pivot axis, the ammunition elements can be loaded in orientations suited for both left-handed use and right-handed use. The lobes on the bottom of the protrusions 86, 88 on the follower and the profile surface portions 84 on the sides of the follower prevent over rotation of the follower.

The ramp 92 on the top 76 of the follower serves two functions. First, it urges the uppermost ammunition element 132 towards the front 22 of the body to facilitate extraction of the uppermost ammunition element. Second, it forces every other ammunition element to opposite sides of the storage chamber 38 in a zigzag fashion to maximize the capacity of the storage chamber. In the current embodiment, the storage chamber is sized to receive 10 shot shells.

The opening 36 at the top 14 of the body 12 that is in communication with the storage chamber 38 is defined at least in part by the flexible fingers 40, 42. The flexible fingers each define a gap 46, 48 with respect to the upper lip 50 of the body. The gaps have a selected first width when the fingers are in an unflexed condition, and a greater selected second width when the fingers are in a flexed position due to application of force. Force is applied to the fingers via the follower 74 urging the uppermost ammunition element 132 upward and forward so that the exterior 138 of the uppermost ammunition element contacts the fingers. The upper ammunition element has a width equal to the selected second flexed position width of the fingers. As a result, the upper ammunition element can only be extracted through the gaps 46, 48 by deliberate force, and the upper ammunition element is restrained against unintended extraction. In the current embodiment, the gaps when the fingers are in the flexed condition are 1 inch wide, and the upper ammunition element has a width of 1 inch.

Figure 6A:
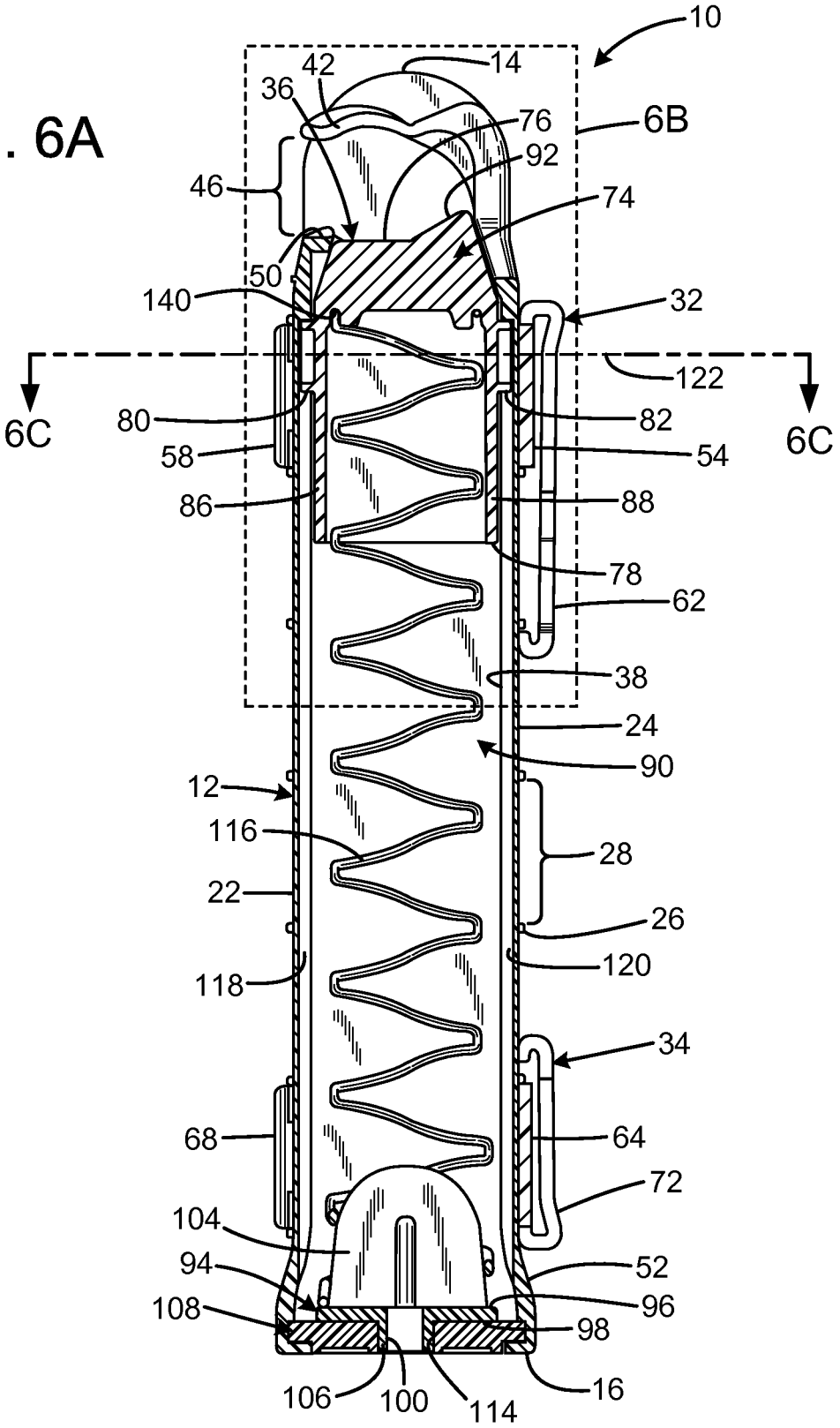
FIG. 6A is a side sectional view of the ammunition dispensing receptacle of FIG. 1.
Figure 6B:
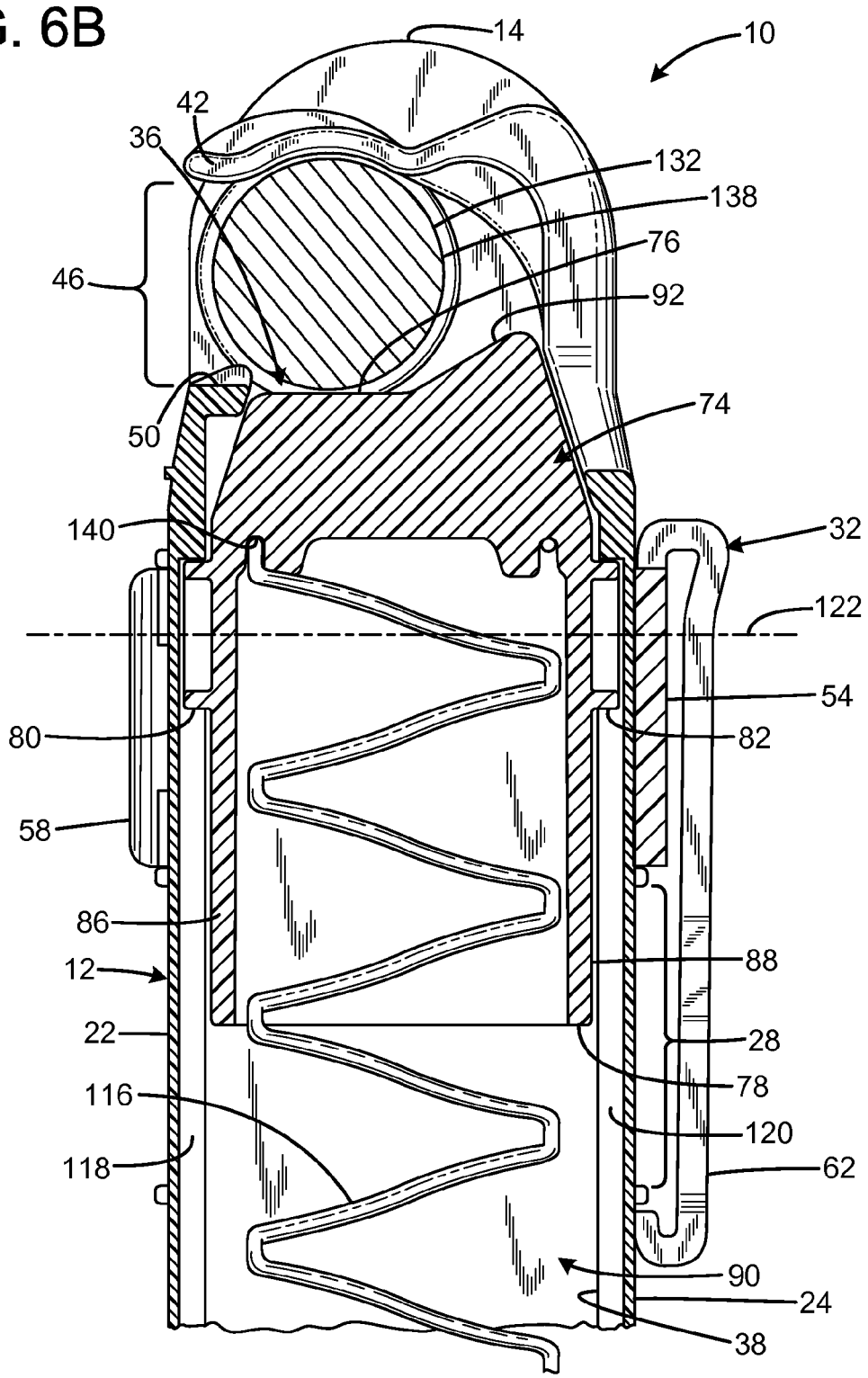
FIG. 6B is an enlarged view of the rectangular area 6B of FIG. 6A.
Figure 6C:
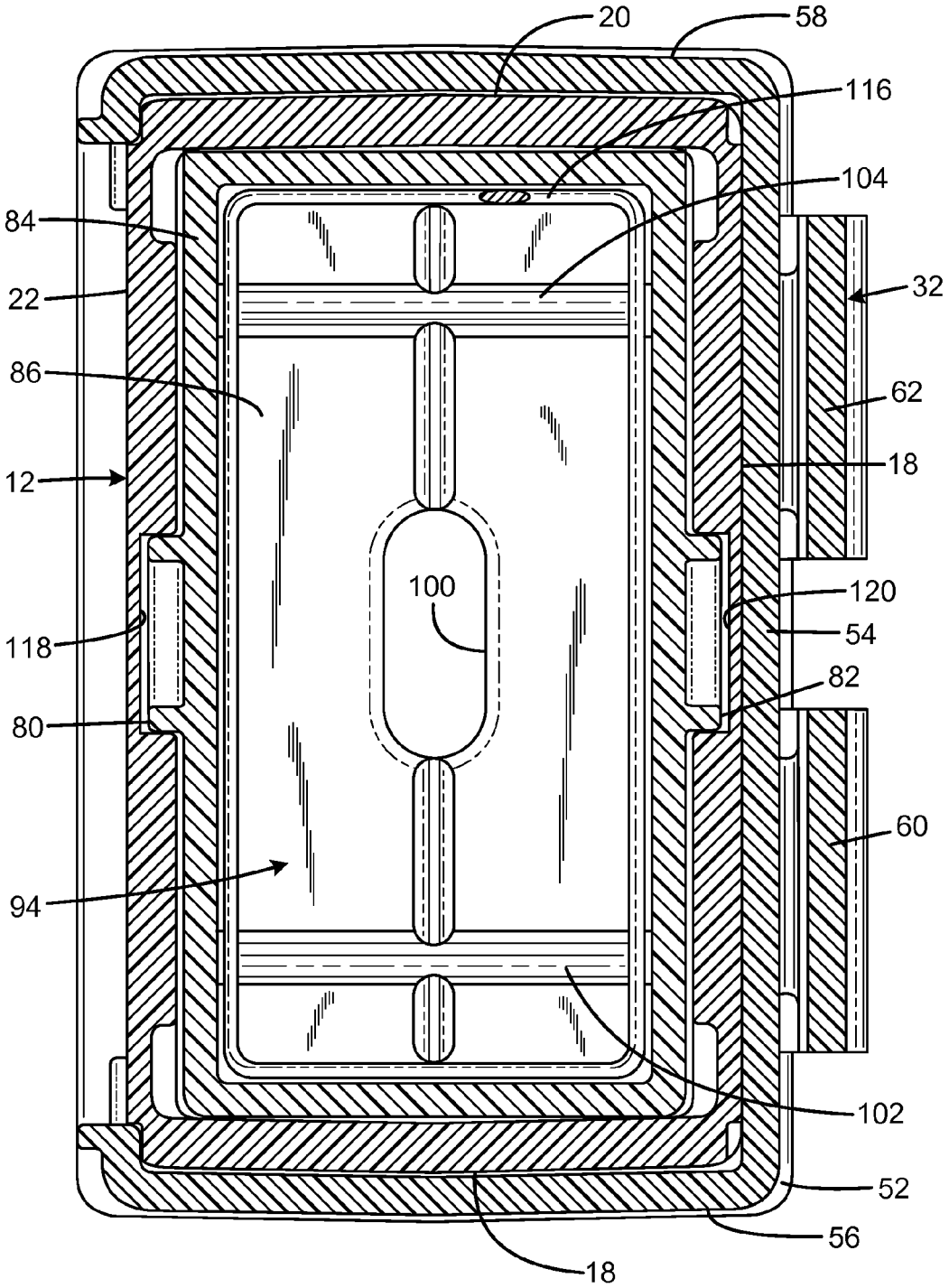
FIG. 6C is a bottom sectional view taken along line 6C-6C of FIG. 6A.
Figure 7:
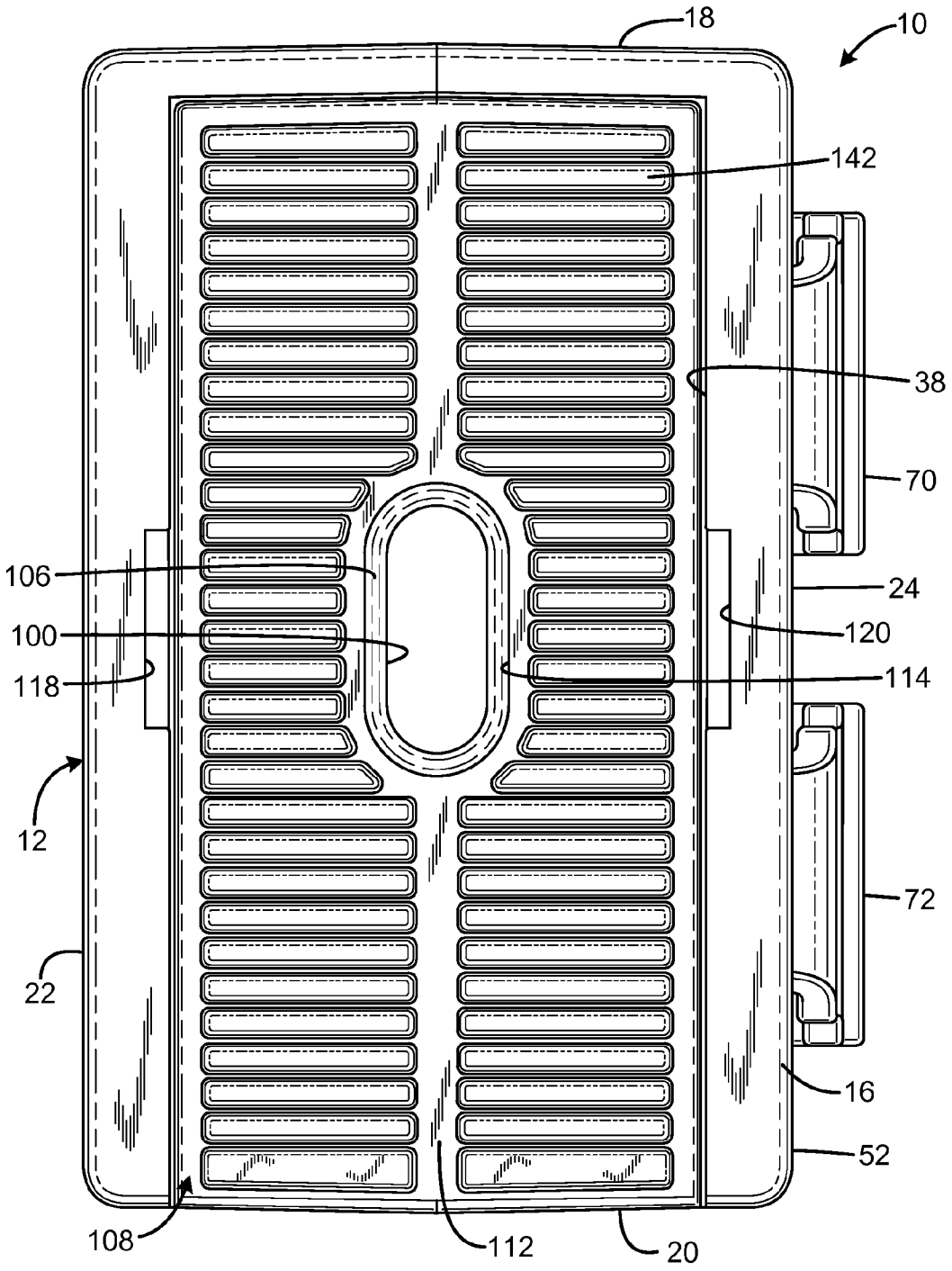
FIG. 7 is a bottom view of the ammunition dispensing receptacle of FIG. 1.

FIG. 7 illustrates the improved ammunition dispensing receptacle 10 of the present invention. More particularly, the drain hole 114 in the floor plate 108 is sized to receive the downward protrusion 106 attached to the spring plate 94 as shown in FIG. 6A. As a result, any fluid within the storage chamber 38 is free to flow downward and out of the storage chamber through the central aperture 100 in the spring plate 94. The serrations 142 on the bottom 112 of the floor plate provide a gripping surface to enable to user to slide the floor plate on and off the bottom 16 of the body 12. The front and rear channels 118, 120 in the front 22 and rear 24 walls of the body 12 are also visible.

To prepare the ammunition dispensing receptacle 10 for use, the user first determines which hand he or she wishes to use to extract the ammunition elements. Based on that decision, the user attaches the upper clip 32 and lower clip 34 to either the front 22 or rear 24 of the body 12. The user then inserts ammunition elements in the desired orientation through the gaps 46, 48, thereby depressing the follower 74.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of an ammunition dispensing receptacle has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ammunition dispensing receptacle comprising:

an elongated tubular body having opposed first and second ends;

the body defining a storage chamber;

the body having an opening at the first end operable to receive and dispense ammunition;

a follower received in the chamber and operable to reciprocate between the first end and the second end;

the follower being spring biased toward the first end;

the follower being operable to pivot with respect to the body, such that a varying number of tapered ammunition elements may be supported by the follower;

wherein the body defines an elongated channel, and the follower includes a protruding pivot element received within the channel, wherein the opening is defined at least in part by a flexible finger defining a gap with respect to a portion of the body, the gap having a first width when the finger is an unflexed condition, and a greater second width when the finger is in a flexed position due to application of force, such that an ammunition element having the second width may be extracted only by deliberate force, and is restrained against unintended extraction;

the flexible finger extending across at least a lower portion of the opening; and the flexible finger having a support surface facing toward the follower and operable to support an ammunition element in resistance to the biasing force of the follower, wherein the body includes elongated end walls joining major sidewalls of the body, the flexible finger being separate from the end walls, and wherein the end walls each have a lower portion extending to a level below a lower edge of at least one of the major sidewalls, such that ammunition is restrained against axial extraction from the receptacle in a direction parallel to the major sidewalls.

2. The ammunition dispensing receptacle of claim 1 wherein the channel has an end portion adjacent to the first end, such that motion of the follower toward the first end is limited by the end portion of the channel.

3. The ammunition dispensing receptacle of claim 1 wherein the follower defines a pivot axis, and includes a profile surface portion concentric with the pivot axis.

4. The ammunition dispensing receptacle of claim 3 wherein the chamber has spaced apart edge walls spaced apart by a first width and wherein the profile surface portion has a radius of less than half the first width, such that the follower is received in the chamber, and motion of the follower toward and away from the edge walls is limited, while pivoting of the follower is enabled.

5. The ammunition dispensing receptacle of claim 3 wherein the follower includes a protrusion extending to a radius greater than a radius of the profile surface portion, such that pivoting of the follower is limited by the protrusion.

6. The ammunition dispensing receptacle of claim 1 wherein the body includes opposed major sidewalls spaced apart by a selected chamber thickness, and wherein the follower has a thickness slightly less than the chamber thickness such that it is closely received within the chamber and limited in its motion other than pivoting, and reciprocating along the length of the chamber.

7. The ammunition dispensing receptacle of claim 1 including a pair of fingers spaced apart by a width sufficient to fit an adult finger between the fingers to facilitate extraction.

8. The ammunition dispensing receptacle of claim 1 wherein the body defines a drain hole in the second end.

9. The ammunition dispensing receptacle of claim 1 wherein the body has a straight rectangular shape, such that it may be used ambidextrously.

10. The ammunition dispensing receptacle of claim 1 including a spring compressively received between the follower and the second end.

11. The ammunition dispensing receptacle of claim 1 wherein the body has opposed major sidewalls, and wherein the flexible finger has a first end connected to a first of the opposed major sidewalls, and having a second free end registered with the second of the opposed major sidewalls.

12. The ammunition dispensing receptacle of claim 11 wherein the flexible finger extends perpendicularly away from the first major sidewall.

13. The ammunition dispensing receptacle of claim 1 wherein the body has opposed major sidewalls, at least one of the major sidewalls defining an elongated guide channel, the follower having a protruding pivot pin received in the channel.

14. The ammunition dispensing receptacle of claim 1 the follower having an ammunition support surface on one side, and having protrusions on the opposite side, the protrusions engaging the interior of the body to limit rotation of the follower.

* * * * *